US007585198B2

(12) United States Patent
Park

(10) Patent No.: US 7,585,198 B2
(45) Date of Patent: Sep. 8, 2009

(54) FLAT LUMINESCENT LAMP AND METHOD FOR MANUFACTURING THE SAME

(75) Inventor: Hong Bae Park, Daejon-Kwangyokshi (KR)

(73) Assignee: LG Display Co., Ltd., Seoul (KR)

( * ) Notice: Subject to any disclaimer, the term of this patent is extended or adjusted under 35 U.S.C. 154(b) by 329 days.

(21) Appl. No.: 11/476,770

(22) Filed: Jun. 29, 2006

(65) Prior Publication Data

US 2006/0246812 A1 Nov. 2, 2006

Related U.S. Application Data

(62) Division of application No. 09/894,903, filed on Jun. 29, 2001, now Pat. No. 7,078,857.

(30) Foreign Application Priority Data

Dec. 27, 2000 (KR) ..... 10-2000-0083097

(51) Int. Cl.
*H01J 9/00* (2006.01)

(52) U.S. Cl. ..... 445/26

(58) Field of Classification Search ..... 313/485, 313/491, 484, 495–497; 445/23–26
See application file for complete search history.

(56) References Cited

U.S. PATENT DOCUMENTS

| | | | | |
|---|---|---|---|---|
| 3,873,870 | A | 3/1975 | Fukushima et al. | |
| 4,767,965 | A | 8/1988 | Yamano et al. | |
| 5,341,231 | A | 8/1994 | Yamamoto et al. | |
| 6,034,470 | A * | 3/2000 | Vollkommer et al. | 313/485 |

FOREIGN PATENT DOCUMENTS

| | | |
|---|---|---|
| JP | 08-162069 | 6/1996 |
| WO | WO 92/02947 | 2/1992 |

* cited by examiner

*Primary Examiner*—Joseph L Williams
(74) *Attorney, Agent, or Firm*—Morgan, Lewis & Bockius LLP

(57) ABSTRACT

A flat luminescent lamp includes first and second substrates attached to each other at a plurality of adhesive portions, a plurality of discharge spaces in regions other than the plurality of adhesive portions between the first and second substrates, first and second electrodes arranged in the discharge spaces to be separated from each other, first and second phosphor layers formed in the discharge spaces, and first and second frames sealing the first and second substrates.

3 Claims, 8 Drawing Sheets

FLAT LUMINESCENT LAMP AND METHOD FOR MANUFACTURING THE SAME

This application is a Divisional of U.S. patent application Ser. No. 09/894,903, filed Jun. 29, 2001 now U.S. Pat. No. 7,078,857 and claims the benefit of Korean Patent Application No. P 2000-83097 filed in Korea on Dec. 27, 2000, both of which are hereby incorporated by reference in their entirety.

BACKGROUND OF THE INVENTION

1. Field of the Invention

The present invention relates to a luminescent lamp, and more particularly, to a flat luminescent lamp and a method for manufacturing the same.

2. Discussion of the Related Art

Ultra thin flat panel display devices, especially liquid crystal display (LCD) devices, are widely used in monitors for notebook computers, spacecrafts, and aircrafts.

A passive luminescence LCD device usually includes a back light provided at the rear of a liquid crystal panel and used as a light source. The back light is inefficient because it increases the weight, power consumption, and thickness of the device.

The back light used as a light source of an LCD is formed in such a manner that a cylindrical fluorescent lamp is often used. There are two types of back light: a direct type and a light-guiding plate type.

In the direct type back light, a fluorescent lamp is mounted on a flat panel. To avoid having the shape of the fluorescent lamp displayed on a liquid crystal panel, it is necessary to maintain the distance between the fluorescent lamp and the liquid crystal panel and arrange a light-scattering means to achieve a uniform light distribution. As a result, it is difficult to form a LCD back light with a very thin size.

As the panel size gets larger, a light-emitting area of the back light increases. If the direct type back light has to cover a large area, the light-scattering means has to have a sufficient thickness to make the light-emitting area flat. This also makes it difficult to form a thin sized back light for LCD devices.

For the light-guiding plate type back light, a fluorescent lamp is mounted outside a flat panel so that light is dispersed in all sides using a light-guiding plate. In this case, since the fluorescent lamp is mounted at one side and light passes through the light-guiding plate, luminance becomes too low. Also, for uniform distribution of luminous intensity, advanced optical design and processing technologies are required.

Currently, to achieve high luminance, a direct type back light has been proposed in which a number of lamps are arranged below a display surface. Alternatively, a lamp with a bent shape is proposed. Recently, a flat luminescent back light with a flat surface facing a display surface of a panel is being researched and developed. This flat luminescent back light is disclosed in U.S. Pat. No. 6,034,470.

A related art flat luminescent lamp will be described with reference to the accompanying drawings.

FIG. 1 is a plane view illustrating a related art flat luminescent lamp, and FIG. 2 is a sectional view taken along line I-I' of FIG. 1.

As shown in FIGS. 1 and 2, the related art flat luminescent lamp includes a lower substrate 11, an upper substrate 11*a*, cathodes 13 formed on the lower substrate 11, anodes 13*a* formed on the upper substrate 11*a*, four frames 19*a*, 19*b*, 19*c*, and 19*d* for sealing the lower and upper substrates 11*a* and 11 by a glass solder, and a plurality of support rods 21 formed between the lower and upper substrates 11 and 11*a*.

The anodes 13*a* are formed in pairs at constant intervals. The cathodes 13 are formed on the corresponding lower substrate 11 between the anodes 13*a* The cathodes 13 and the anodes 13*a* are coated with a dielectric material, and an external voltage is applied to the cathodes 13 and the anodes 13*a* through a lead line.

A surface of the upper and lower substrates 11*a* and 11 facing a discharge space is coated with a fluorescent material. In the discharge space, a Xe gas induces discharge, forms plasma and emits ultraviolet rays (UV). The emitted UV comes into collision with the fluorescent material formed on the upper and lower substrates 11*a* and 11. For this reason, the UV is excited to generate visible rays.

Additionally, a reflecting plate 14 is further provided on the lower substrate 11. The reflecting plate 14 serves to prevent the visible rays generated in the discharge space from leaking out to the rear of the lower substrate 11. The support rods 21 are made of a glass material so as not to interrupt emission of the visible rays.

Meanwhile, referring to FIG. 2, the cathodes 13 are formed on the lower substrate 11 of glass material, and a first dielectric material layer 12 is formed on the lower substrate 11 including the cathodes 13. The reflecting plate 14 is formed on the first dielectric material layer 12 and a first phosphor layer 15 is formed on the reflecting plate 14. The anodes 13*a* that induce discharge together with the cathodes 13 are formed on the upper substrate 11*a* of glass material. A second dielectric material layer 12*a* is formed on the upper substrate 11*a* including the anodes 13*a*. A second phosphor layer 15*a* is formed on the second dielectric material layer 12*a*. On the upper and lower substrates 11*a* and 11, frames 19*a*, 19*b*, 19*c*, and 19*d* are formed to seal the upper and lower substrates 11*a* and 11 by a glass solder.

The cathodes 13 and the anodes 13*a* are formed by a silk printing or vapor deposition process.

In the aforementioned related art flat luminescent lamp, if the voltage is applied to the cathodes 13 and the anodes 13*a* through the lead line, the Xe gas forms plasma in the discharge space between the cathodes 13 and the anodes 13*a* and emits UV. At this time, the UV comes into collision with the first and second phosphor layers 15 and 15*a* to generate visible rays.

However, the related art flat luminescent lamp has several problems. Since four frames and a number of the support rods are required to seal the lower and upper substrates, the number of parts for manufacturing the lamp increases and the process steps become complicated. This also leads to the increased weight and volume of the lamp.

SUMMARY OF THE INVENTION

Accordingly, the present invention is directed to a flat luminescent lamp and a method for manufacturing the same that substantially obviate one or more of the problems due to limitations and disadvantages of the related art.

An object of the present invention is to provide a flat luminescent lamp and a method for manufacturing the same, in which the number of parts is minimized to minimize the process steps, thereby reducing the manufacturing cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a flat luminescent lamp according to the present invention includes first and second substrates attached to each other at a plurality of adhesive portions, a plurality of discharge spaces extended in a stripe shape in regions other than the adhesive portions, first and second electrodes arranged in the discharge spaces to be separated from each other, first and second phosphor layers formed in the discharge spaces including the first and second electrodes, and first and second frames sealing the first and second substrates.

To further achieve these and other advantages and in accordance with the purpose of the present invention, as embodied and broadly described, a method for manufacturing a flat luminescent lamp according to the present invention includes the steps of forming a plurality of stripe shaped grooves in first and second substrates, forming first and second electrodes on the first and second substrates in the grooves, forming a reflecting material layer on the first substrate in the grooves including the first electrode, forming first and second phosphor layers in the grooves including the reflecting material layer and the second electrode, attaching the first and second substrates to each other so that the grooves face each other, and sealing the first and second substrates after injecting a phosphor gas into the grooves.

In the preferred embodiment of the present invention, the grooves are respectively formed in the first and second substrates (lower and upper substrates), and the first and second substrates are attached to each other so that the grooves formed in the first substrate face the grooves formed in the second substrate. Before the first and second substrates are attached to each other, the first electrode which will be a cathode is formed in the groove of the first substrate and a first dielectric layer is formed in the grooves including the first electrode. A reflecting material layer is formed on the first dielectric layer and the first phosphor layer is formed on the reflecting material layer.

The second electrode which will be an anode is formed in the groove of the second substrate and a second dielectric layer is formed in the grooves including the second electrode. The second phosphor layer is formed on the second dielectric layer.

If the first and second substrates provided with the electrodes and the phosphor layers in the grooves are attached to each other to face each other, the grooves formed in the first substrate and the grooves formed in the second substrate form certain spaces that serve as discharge spaces.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIGS. 8A to 8E are sectional views illustrating process steps of manufacturing a flat luminescent lamp according to the present invention, in which FIGS. 8A and 8E are sectional views taken along line III-III' of FIG. 3 and FIGS. 8B to 8D are sectional views taken along line II-II' of FIG. 3.

DETAILED DESCRIPTION OF THE PREFERRED EMBODIMENTS

Reference will now be made in detail to the preferred embodiments of the present invention, examples of which are illustrated in the accompanying drawings.

Figure 1:
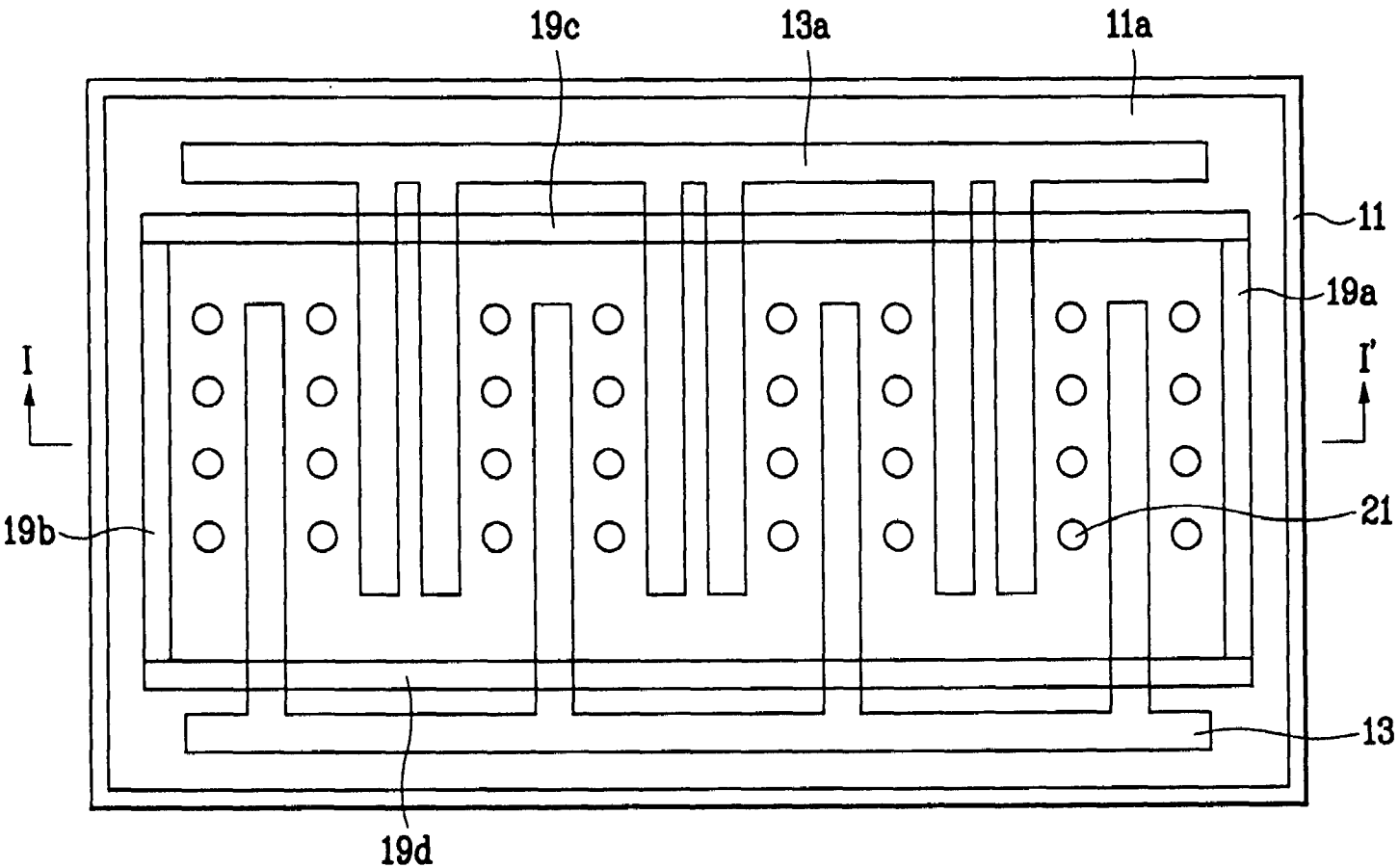
FIG.1 Related Art
FIG. 1 is a plane view illustrating a related art flat luminescent lamp.
Figure 2:
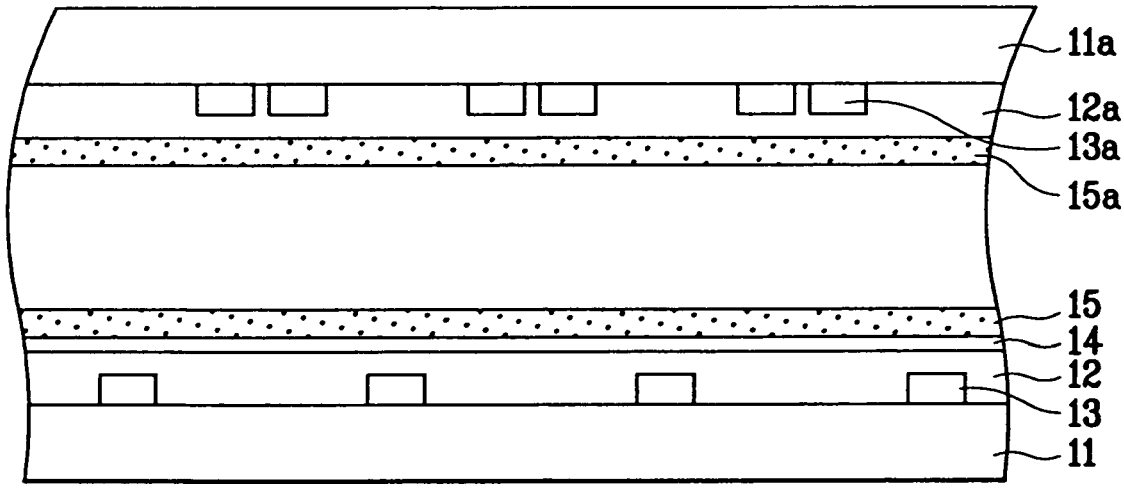
FIG.2 Related Art
FIG. 2 is a sectional view taken along line I-I' of FIG. 1.
Figure 3:
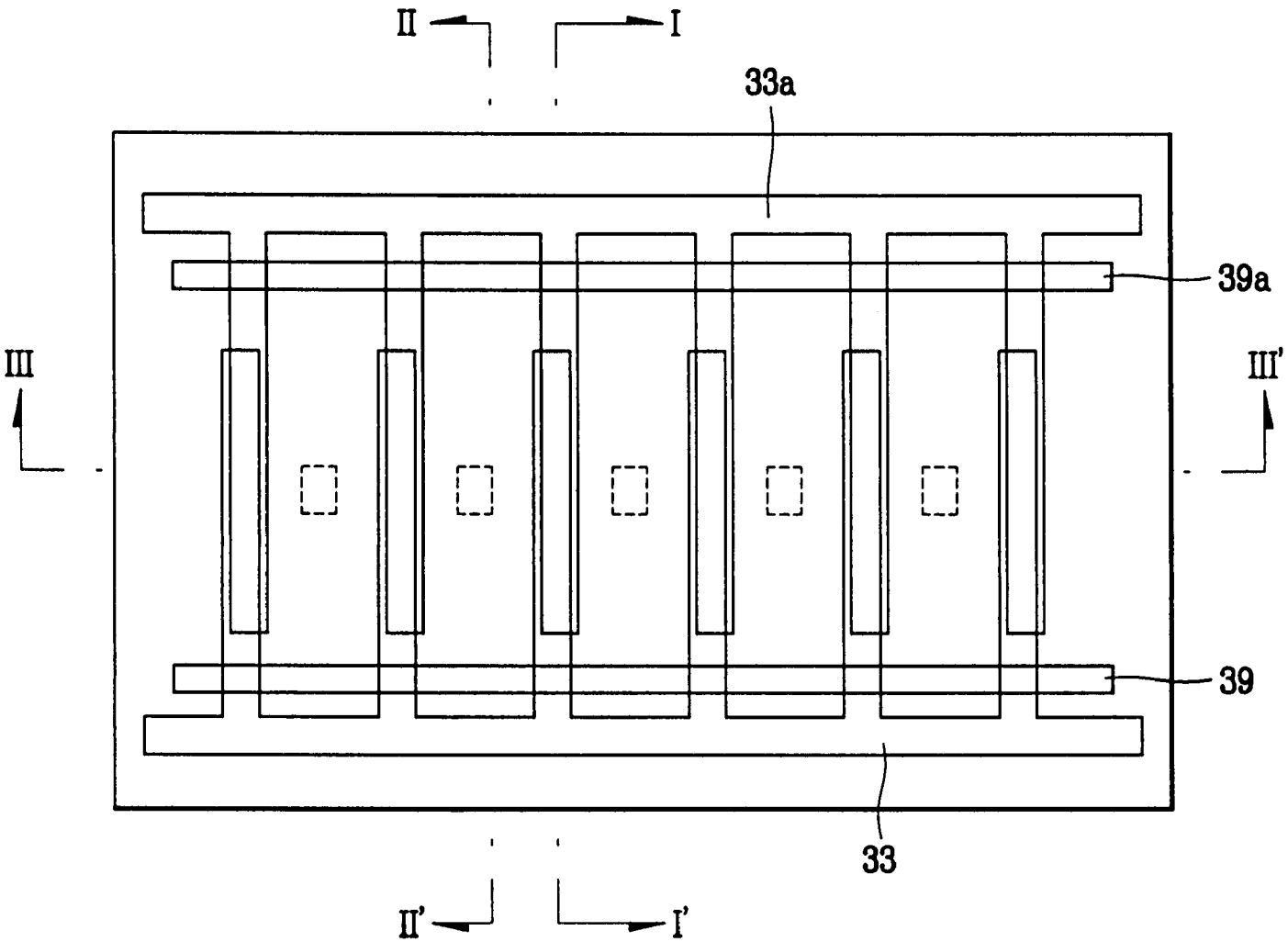
FIG. 3 is a plane view illustrating a flat luminescent lamp according to the present invention.
Figure 4:
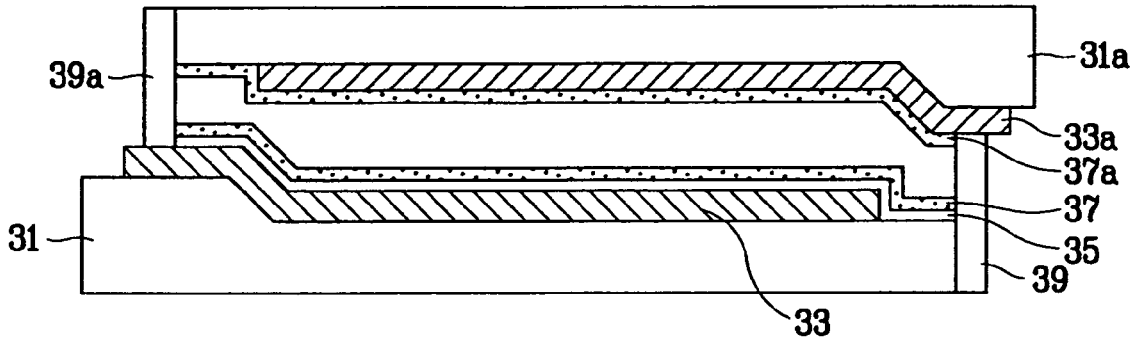
FIG. 4 is a sectional view taken along line I-I' of FIG. 3.
Figure 5:
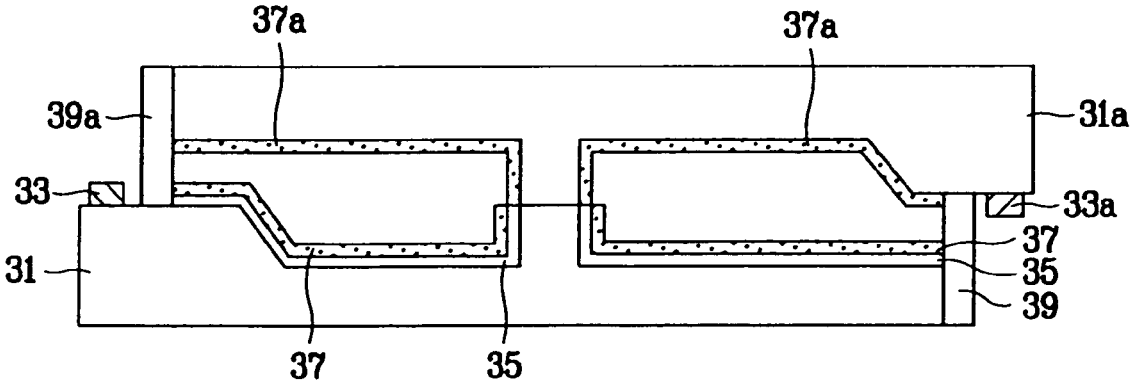
FIG. 5 is a sectional view taken along line II-II' of FIG. 3.

FIG. 3 is a plane view illustrating a flat luminescent lamp according to the present invention, FIG. 4 is a sectional view taken along line I-I' of FIG. 3, and FIG. 5 is a sectional view taken along line II-II' of FIG. 3.

As shown in FIGS. 3 to 5, the flat luminescent lamp according to the present invention includes first and second substrates 31 and 31*a* attached to each other to face each other, each having a plurality of grooves on an attached surface. First and second electrodes 33 and 33*a* are arranged in the grooves to be separated from each other in the up and down direction. First and second phosphor layers 37 and 37*a* are formed in the grooves including the first and second electrodes 33 and 33*a*. First and second frames 39 and 39*a* are used for sealing the first and second substrates 31 and 31*a*.

The first and second substrates 31 and 31*a* are typically formed of a glass material. However, the first substrate 31 may be formed of a ceramic material.

The grooves have a stripe shape and are used as discharge spaces that emit white light by discharge between the first and second electrodes 33 and 33*a*. Both ends of each groove are connected with both ends of a neighboring groove so that a light-emitting area is maximized.

The grooves are formed in vertical direction relative to the substrates while the first and second frames 39 and 39*a* are formed in horizontal direction relative to the substrates.

Areas marked by dotted lines in FIG. 3 represent attached surfaces between the first and second substrates 31 and 31*a*.

As shown in FIG. 4, a reflecting material layer 35 is further provided on the first substrate 31. The reflecting material layer 35 serves to direct and concentrate the white light generated by discharge between the first and second electrodes 33 and 33*a* toward the second substrate 31*a* so that it does not leak out to the first substrate 31.

A dielectric layer (not shown) may further be provided on an entire surface including the first and second electrodes 33 and 33*a* In such a case, the reflecting material layer 35 is formed on the dielectric layer.

The first electrode 33 is a cathode while the second electrode 33*a* is an anode. Preferably, the second electrode 33*a* is formed of a transparent conductive material such as indium tin oxide (ITO). The second electrodes 33*a* may also be formed of other transparent or non-transparent conductive material. If the second electrode 33*a* is formed of non-transparent material, a diffusion sheet is further provided on the second substrate 31*a* so that the white light is uniformly emitted along an entire region of the light-emitting surface.

Meanwhile, the discharge spaces are formed in a stripe shape, and both ends of each discharge space are connected with both ends of a neighboring discharge space.

Figure 6:
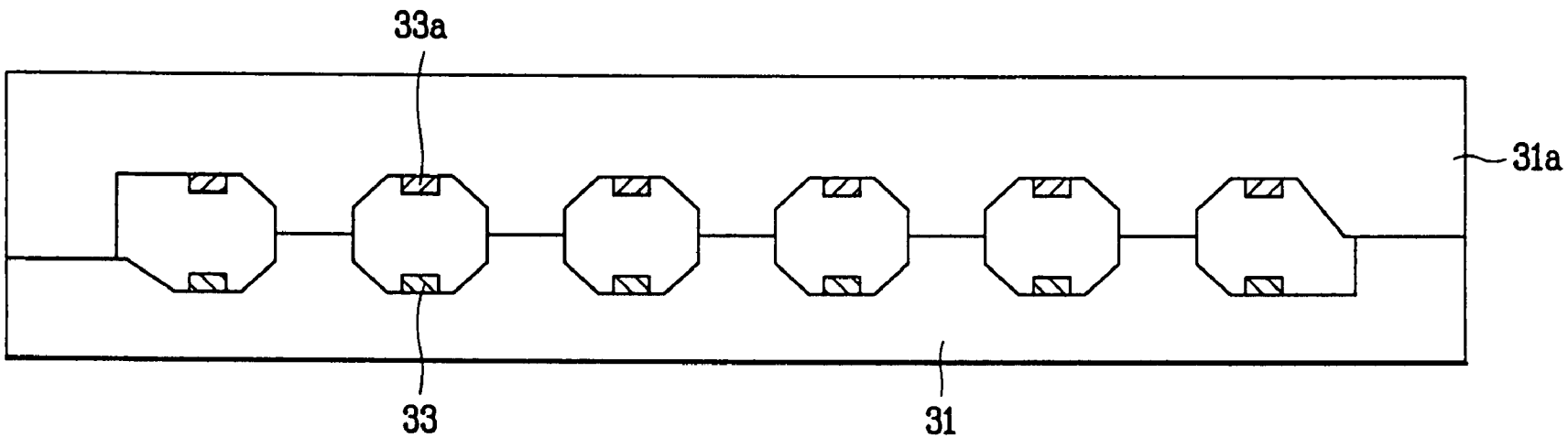
FIG. 6 is a sectional view taken along line III-III' of FIG. 3.

The grooves which will be discharge spaces, as shown in FIG. 6, are formed in such a manner that both ends of each groove are connected with both ends of a neighboring groove to maximize a discharge space.

Figure 7A:
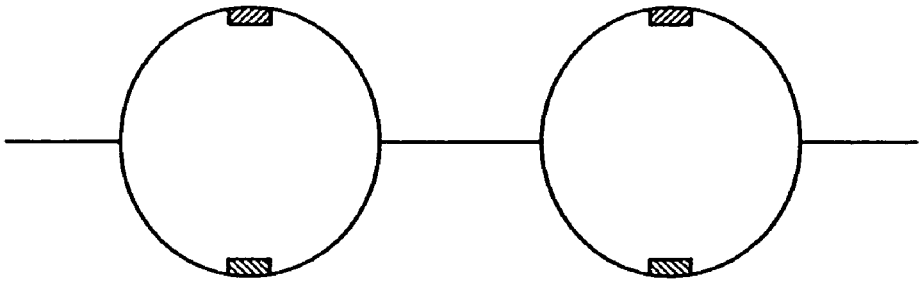
FIGS. 7A to 7C show discharge spaces according to a flat luminescent lamp of the present invention.
Figure 7B:
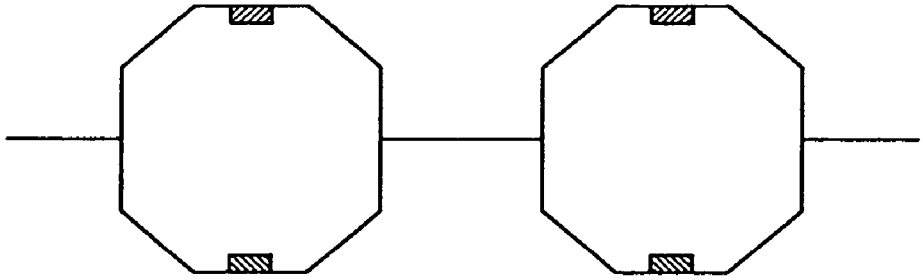

It is desirable that the grooves are formed in a shape that induces discharge. For example, if the grooves have a rectangular shape, the discharge efficiency at four corners may deteriorate. Accordingly, the grooves are preferably formed in a round shape as shown in FIG. 7A or a shape with a plurality of surfaces (e.g., a polygon shape) close to the round shape as shown in FIG. 7B so that the distance between a light-emitting central portion of the discharge space and the phosphor layer is uniformly maintained.

Furthermore, the first and second substrates 31 and 31*a* are attached to each other at a very small area so that brightness of light is maximized.

Figure 7C:
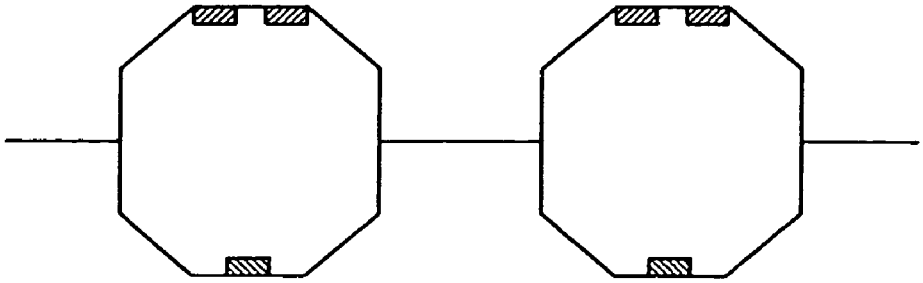

In FIG. 3, the second electrode 33*a* is formed of separate singular electrodes. However, as shown in FIGS. 7A-7C, depending on electrode design, two electrodes in pairs may be formed or three electrodes or more in one group may be formed.

The operation of the aforementioned flat luminescent lamp according to the present invention is similar to the operation of the related art flat luminescent lamp. That is, if a voltage is applied to the first and second electrodes 33 and 33*a* after an external power source is respectively connected with them, Xe gas forms plasma and emits UV between the first and second electrodes 33 and 33*a*. The UV comes into collision with the first and second phosphor layers 37 and 37*a* to generate white light. The white light is emitted to the second substrate 31*a* without being leaked out to the first substrate 31 by the reflecting material layer 35 formed in the first substrate 31.

If the aforementioned flat luminescent lamp is used as a back light of an LCD device, an LCD panel is arranged at the rear of the second substrate 31*a*.

Figure 8A:
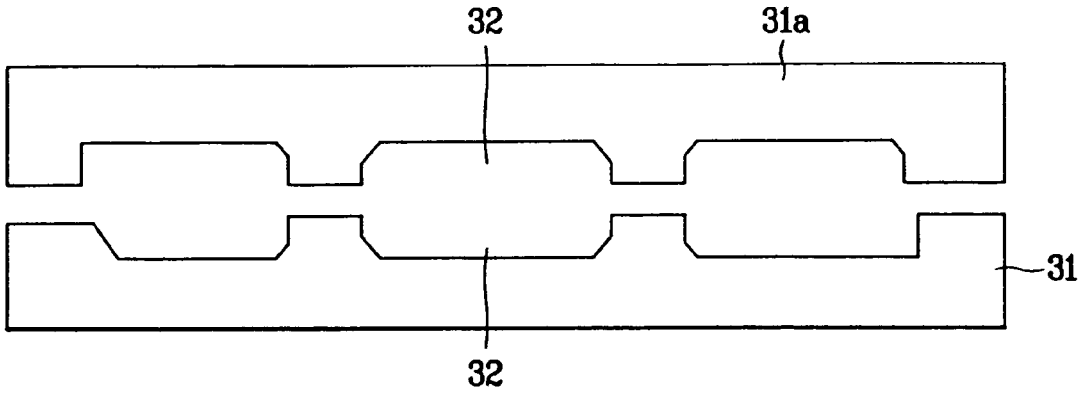
Figure 8B:
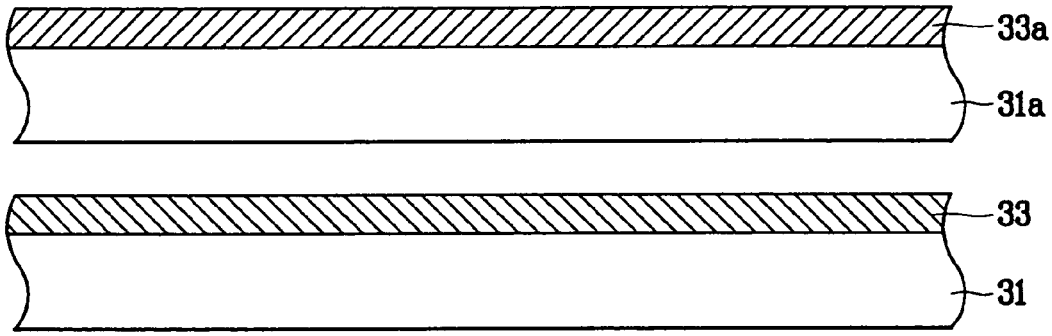

A method for manufacturing the flat luminescent lamp according to the present invention will now be described with reference to FIGS. 8A to 8E. FIGS. 8A and 8E are sectional views taken along line III-III' of FIG. 3, and FIGS. 8B to 8D are sectional views taken along line II-II' of FIG. 3.

As shown in FIG. 8A, a plurality of grooves 32 are formed in the first and second substrates 31 and 31*a*. FIG. 8B shows an enlarged inner portion of the grooves. Using silk printing, vapor deposition process, or photolithography process, the first electrode 33 (i.e., the cathode) is formed on the first substrate 31 while the second electrode 33*a* (i.e., the anode) is formed on the second substrate 31*a*.

At this time, the grooves may be formed by molding or etching the first and second substrates 31 and 31*a* The second electrode 33*a* is formed of a transparent conductive material such as ITO so that the white light is emitted by passing through the transparent second electrode 33*a*.

Additionally, the first and second electrodes 33 and 33*a* may be formed of a metal having low specific resistance, such as Ag, Cr, Pt, and Cu.

Figure 8C:
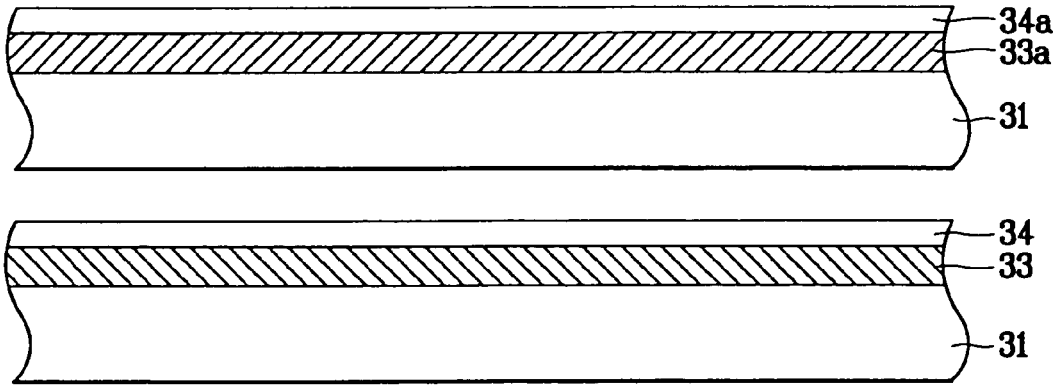

Afterwards, as shown in FIG. 8C, the first dielectric layer 34 is formed on the first substrate 31 including the first electrode 33 while the second dielectric layer 34*a* is formed on the second substrate 31*a* including the second electrode 33*a*.

Figure 8D:
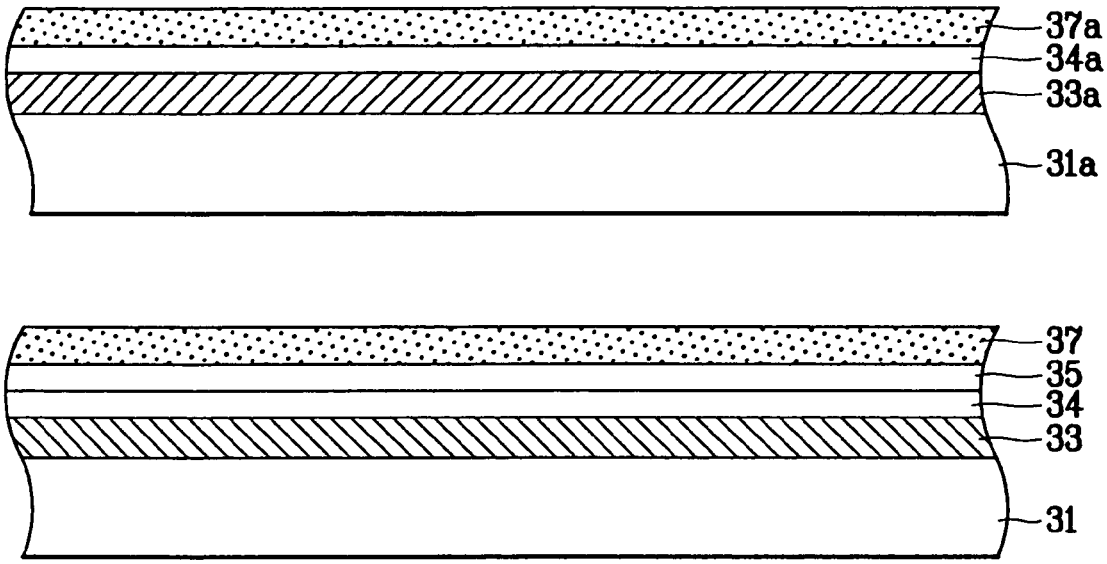
Figure 8E:
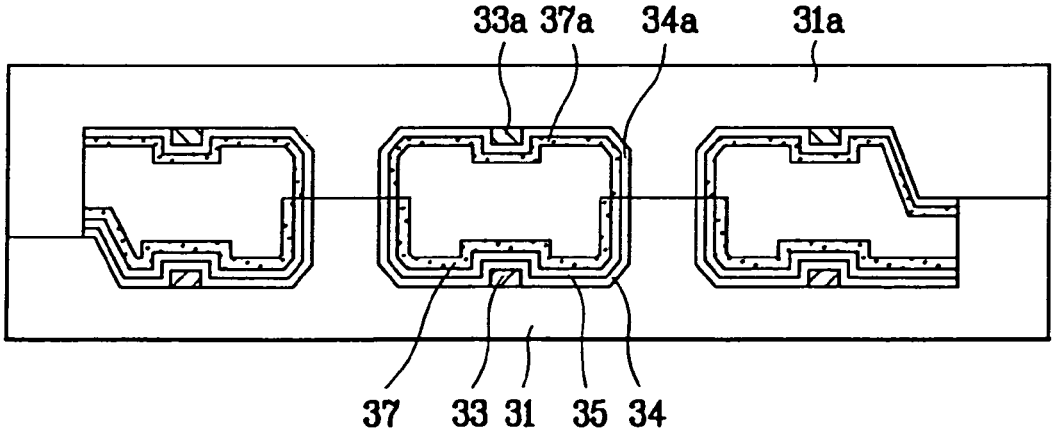

Subsequently, as shown in FIG. 8D, the reflecting material layer 35 of AlN, $BaTiO_3$, $SiN_x$, or $SiO_x$ is formed on the first dielectric layer 34. The reflecting material layer 35 is formed to direct and concentrate the white light generated by collision between the UV and the phosphor layers toward the second substrate 31*a* so that the white light does not leak out to the first substrate 31.

The first and second phosphor layers 37 and 37*a* are formed on the reflecting material layer 35 and the second dielectric layer 34*a*. The first and second substrate 31 and 31*a* are then attached to each other, as shown in FIG. 8E. A phosphor gas, such as Xe gas, is injected between them through a gas injection hole (not shown), and the substrates 31 and 31*a* are sealed through first and second frames (not shown) using a solder means such as a glass solder. Thus, the process for manufacturing the flat luminescent lamp according to the present invention is completed.

The flat luminescent lamp according to the present invention can be used as a lighting device and can also be used as a separate light source at the rear or front of display devices such as monitors, notebook PCs, and TVs.

As described above, the flat luminescent lamp and the method for manufacturing the same according to the present invention have the following advantages.

Since only two frames are required and no separate support rod is formed between the first and second substrates, the number of parts required for making the lamp can be minimized, thereby saving the manufacturing cost. Furthermore, since no separate support rod is formed and the first and second substrates are directly attached to each other, it is possible to achieve strong support and improve durability of the product. Moreover, since the grooves are formed in the substrate and used as discharge spaces, the thickness and weight of the product can be minimized.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method for manufacturing a flat luminescent lamp comprising the steps of:

forming a plurality of stripe shaped grooves in first and second substrates;

forming first and second electrodes on the first and second substrates in the grooves;

forming a reflecting material layer on the first substrate in the grooves including the first electrode in the grooves;

forming phosphor layers in the grooves including the reflecting material layer and the second electrode in the grooves;

attaching the first and second substrates to each other so that the grooves face each other; and sealing the first and second substrate using the first and second frames after injecting a phosphor gas into the grooves, wherein the first frame is attached to a side surface of the first substrate and the second frame is attached to a side surface of the second substrate, wherein the first and second electrodes respective are formed in stripe shape along the grooves and overlap each other.

2. The method of claim 1, further comprising the step of forming a dielectric layer after forming the first and second electrodes.

3. The method of claim 1, wherein the grooves are formed so that both ends of neighboring grooves are connected with each other.

* * * * *